US006030443A

United States Patent [19]

Bock et al.

[11] Patent Number: 6,030,443

[45] Date of Patent: Feb. 29, 2000

[54] PAPER COATING COMPOSITION WITH IMPROVED OPTICAL BRIGHTENER CARRIERS

[75] Inventors: Eric F. Bock, New Castle County, Del.; Charles L. Burdick, Chester County, Pa.; L. Drake Walsh, New Castle County, Del.

[73] Assignee: Hercules Incorporated, Wilmington, Del.

[21] Appl. No.: 09/301,983

[22] Filed: Apr. 29, 1999

[51] Int. Cl.[7] ..... C09D 101/28; C09D 105/00; D21H 17/24; D21H 17/26; D21H 17/32

[52] U.S. Cl. ..... 106/217.5; 106/173.01; 106/205.1; 106/209.1; 162/175; 162/177; 162/178

[58] Field of Search ..... 106/173.01, 205.1, 106/209.1, 217.5; 162/175, 177, 178

[56] References Cited

U.S. PATENT DOCUMENTS

| | | | |
|---|---|---|---|
| 2,582,357 | 1/1952 | Sargent | 260/29.6 |
| 2,710,285 | 6/1955 | Trusler | 252/301.2 |
| 2,846,397 | 8/1958 | Ackermann | 252/89 |
| 3,211,665 | 10/1965 | Allen et al. | 252/301.2 |
| 3,366,575 | 1/1968 | Ono et al. | 252/301.2 |
| 3,475,190 | 10/1969 | Fischer et al. | 106/210 |
| 3,773,464 | 11/1973 | Streck | 8/93 |
| 3,892,675 | 7/1975 | Clarke et al. | 252/301.3 |
| 4,094,634 | 6/1978 | Becker et al. | 8/1 |
| 4,169,810 | 10/1979 | Gunther et al. | 252/301.24 |
| 4,210,488 | 7/1980 | Reuss et al. | 162/162 |
| 4,298,490 | 11/1981 | Lange et al. | 252/91 |
| 4,309,316 | 1/1982 | Lange et al. | 252/543 |
| 4,384,069 | 5/1983 | Wendel et al. | 524/521 |
| 5,076,968 | 12/1991 | Fringeli et al. | 252/543 |
| 5,266,078 | 11/1993 | Welkener et al. | 8/648 |
| 5,482,514 | 1/1996 | von Raven | 8/110 |
| 5,622,749 | 4/1997 | Rohringer et al. | 427/158 |
| 5,885,340 | 3/1999 | Bailey et al. | 106/209.1 |

FOREIGN PATENT DOCUMENTS

| | | | |
|---|---|---|---|
| 20 17 276A | of 1971 | Germany | D21H 1/22 |
| 610149A | of 1986 | Japan | B41M 5/00 |
| 90023639 | of 1987 | Japan | F02B 37/12 |

OTHER PUBLICATIONS

Barnard, J.D.; "The Role of OBAs and Cross Linking Agents", Paper Technology, 33, No. 9, pp. 24–30 (1992).

Miller, G.D.; Jones, R.B.; Boylan, J.R.; "Polyvinyl Alcohol–A Specialty Polymer for Paper and Paperboard", Proceedings of the 1998 TAPPI Notes.

*Primary Examiner*—David Brunsman
*Attorney, Agent, or Firm*—David Edwards

[57] ABSTRACT

A paper coating composition has therein an optical brightening agent (OBA) and a water-soluble non-ionic polysaccharide derivative, exhibiting a solution viscosity in water of less than 1500 cps when dissolved at 5% polymer concentration, wherein the paper coating provides improved optical brightness as compared to the same formulation without said non-ionic, polysaccharide derivative. A paper coated with this composition has an optical brightness value of greater than 70.

34 Claims, No Drawings

PAPER COATING COMPOSITION WITH IMPROVED OPTICAL BRIGHTENER CARRIERS

FIELD OF THE INVENTION

The present invention relates to a paper-coating composition that enhances optical brightness of coated paper. More specifically, this invention relates to a paper coating composition that has an improved carrier for the optical brightening agents that makes the system more efficient.

BACKGROUND OF THE INVENTION

Prior to the present invention, it was often desirable by coated paper producers to achieve high brightness in the final coated paper product in order to enhance the visual appearance of the paper. Thus, it has become established practice for paper producers to utilize high brightness pigments, such as calcium carbonate and titanium dioxide, and to incorporate fluorescent agents as components of paper coating formulations in order to increase the brightness of paper. These fluorescent agents (more commonly referred to as "optical brightener agents") act by absorbing light radiation waves in the ultraviolet wavelength of the spectrum and re-emitting these light waves in the visible spectrum.

The drawback to the use of these optical brightener agents (OBA) is that their efficiency, when used without other activity-enhancing adjuncts, is relatively poor. OBAs have no inherent affinity for pigments and synthetic lattices, and so in modern paper coatings they are relatively ineffective unless employed with some other component of the coating which has an affinity for the OBA. Thus, it has become an established practice in the paper industry to use OBAs in conjunction with other additives, known as "OBA carriers" that have been empirically established to enhance the OBA effectiveness in paper coatings.

Generally, OBA carriers that are presently being used commercially include polyvinyl alcohol and sodium carboxymethylcellulose. Other materials, noted in the literature that can enhance OBA activity, are: hydroxyethylcellulose, starch, casein, melamine formaldehyde resins, urea formaldehyde resins, and polyglycols. Many of these materials are co-binders commonly used in coatings, and some are crosslinking agents. Hence, these materials are useful tools to enable the paper industry to make efficient use of the OBAs.

It is desired simply that the combined use of OBAs with a selected carrier would provide a higher brightness value of coated paper than that otherwise obtained from the use of prior art OBA and carrier.

U.S. Pat. No. 5, 622,749 discloses the use of PVA or CMC as dispersing agent or auxiliaries with fluorescent whitening agents. Japanese publication JP 90023639 B discloses the use of PVA or its derivatives as a whitening aid with stibene type OBAs in order to prevent discoloration or yellowing by light or heat.

Japanese publication JP 61014979 (86) A discloses the use of water-soluble cellulose derivatives, such as hydroxyethylcellulose, as a carrier for an anionic florescent agent. German publication DE 20 17276-A discloses improving a composition containing a pigment, a binder, an anionic dispersion agent, optionally an OBA, and usual additives dispersed in water by the addition of polyvinylpyrrolidone for enhancing the effect of the OBA.

U.S. Pat. No. 3,892,675 discloses the use of sparingly water-soluble OBAs in coating compositions containing white pigment extenders such as clay and polyvinyl acetate latex as sole binding agent; cellulose ethers, such as CMC, are disclosed as thickeners for the formulation. Publication by J. D. Barnard entitled "The Role of OBAs and Crosslinking Agents" in Paper Technology, 33, No. 9, on pages 24 to 30 (1992) describes the role of OBAs and crosslinking agents in determining the brightness and water resistance of paper. The publication on page 25 lists all of the above noted carriers for OBAs.

SUMMARY OF THE INVENTION

The present invention is an additive system for paper coatings of low viscosity nonionic water-soluble polysaccharide derivatives that are used as carriers for optical brightener fluorescing agents in pigmented paper coatings. Paper coated with these compositions has a significantly brighter surface than a paper coated with the same OBA without the use of these polysaccharide derivatives.

The present invention, also, can be used in a size press application of a starch coating applied to paper. In this instance, no pigment would be present but only the starch, the OBA, and carrier as the primary ingredients.

The present invention is directed to a paper coating composition comprising an optical brightening agent (OBA) and a low viscosity, non-ionic, water-soluble polysaccharide derivative, that exhibits a solution Brookfield viscosity of less than about 1500 centipoise when dissolved in water at a polymer concentration of 5% by weight at ambient temperature (25° C.) wherein the paper coating provides improved optical brightness as compared to the same formulation without said non-ionic, water soluble, polysaccharide derivative.

The present invention, also, relates to a method of brightening paper comprising coating the paper with the above-mentioned composition.

The present invention also comprehends a paper coated with the above-mentioned composition.

The present invention, also, is directed to a method of making the above mentioned paper coating composition comprising combining an optical brightening agent and a water-soluble, non-ionic, polysaccharide derivative that exhibits a solution Brookfield viscosity of less than about or equal to 1500 centipoise when dissolved in water at a polymer concentration of 5% by weight at 25° C.

DETAILED DESCRIPTION OF THE INVENTION

It has been surprisingly found that low molecular weight forms of nonionic, water-soluble, polysaccharide derivatives, when used in conjunction with certain other additives, known as fluorescing agents, as components of a paper coating formulation, significantly increase the brightness of coated paper or offer other advantages as compared to prior art additive systems.

In accordance with the present invention, preferred polysaccharide derivatives are nonionic, water-soluble cellulose ethers. Examples of the cellulose ethers are hydroxyethylcellulose (HEC), hydroxypropylcellulose (HPC), methylcellulose (MC), methylhydroxyethylcellulose (MHEC), methylhydroxypropylcellulose (MHPC), ethylhydroxyethylcellulose (EHEC), hydroxyethylmethylcellulose (HEMC), hydroxyethylguar, hydroxypropylguar, hydroxyethylstarch, and hydroxypropylstarch. The polysaccharide derivatives of this invention also can be hydrophobically modified with C4–28 alkyl or aryl, or arylalkyl groups. The preferred cellulose ether is a low molecular weight HEC.

The present invention is, in essence, the concerted use of two ingredients in a pigmented paper coating: 1) a low viscosity water-soluble nonionic water-soluble polysaccharide derivative, and 2) a fluorescing agent. These two ingredients when employed as additives in a standard pigmented paper coating formulation, that also contains pigment and binder, impart higher brightness to coated paper than either the OBA or the water-soluble polymer when used alone would impart to such paper.

In a typical paper coating, the coating formulation is prepared by dispersing pigments, such as kaolin clay and calcium carbonate into water, then adding in binder, such as polystyrene butadiene copolymer and/or an aqueous solution of cooked starch. Other paper coating ingredients, such as rheological modifiers, biocides, lubricants, antifoaming compounds, crosslinkers, and pH adjusting additives may also be present in small amounts in the coating.

Examples of pigments that can be used in coating formulations are kaolin, calcium carbonate (chalk), China clay, amorphous silica, silicates, barium sulfate, satin white, aluminum trihydrate, talcum, titanium dioxide and mixtures thereof. Examples of binders are starch, casein, soy protein, polyvinylacetate, styrene butadiene latex, acrylate latex, vinylacrylic latex, and mixtures thereof. Other ingredients that may be present in the paper coating are, for example, dispersants such as polyacrylates, lubricants such as stearic acid salts, preservatives, antifoam agents that can be either oil based, such as dispersed silica in hydrocarbon oil, or water-based such as hexalene glycol, pH adjusting agents such as sodium hydroxide, rheology modifiers such as sodium alginates, carboxymethylcellulose, starch, protein, high viscosity hydroxyethylcellulose, and alkali-soluble lattices.

According to the present invention, a quantity of water-soluble polysaccharide derivative is added to the coating formulation at a dosage amount having an upper limit of about 3.0 parts active ratio based upon the pigment component. The preferred upper limit is about 2.0 parts and more preferably about 1.0 part. The lower limit of the polysaccharide derivative is about 0.1 part, preferably about 0.2 part, and more preferably about 0.3 part.

The solution viscosity range of the low viscosity, water-soluble polysaccharide derivatives of the present invention, when dissolved in a ratio of 5 parts by weight of polymer in 95 parts of water exhibits less than 1500 cps viscosity as measured by a standard Brookfield instrument at ambient temperature. Preferably, the viscosity should be less than 1000 cps and more preferably less than 500 cps.

The use of such water-soluble polymers is advantageous as compared to prior art use of higher viscosity, water-soluble polysaccharides in that such low viscosity additives can be incorporated at relatively high dosages into paper coatings without causing excess thickening of the coating that would limit its ease of metering onto a paper web.

To improve ease of incorporation into paper coating formulations polysaccharide derivatives can be prepared in concentrated aqueous suspension form (see U.S. Pat. Nos. 4,883,536 and 5,028,263). For example, concentrated suspensions of polysaccharide derivatives can be prepared by dissolving specific inorganic dispersants and stabilizers in water by a proprietary process and then adding 25% by weight of the polysaccharide derivative to this solution. Thus, based on this patented technology the commercial products (i.e., ADMIRAL® 3089FS Fluidized Polymer Suspension, ADMIRAL® 2089FS Fluidized Polymer Suspension and ADMIRAL® 1089FS Fluidized Polymer Suspension) have been developed by Hercules Incorporated. ADMIRAL® 3089FS Fluidized Polymer Suspension comprises an HEC polymer that produces an aqueous viscosity of greater than about 2000 cps when added to water in a ratio such that the HEC concentration is 5% by weight. By comparison both ADMIRAL® 2089FS Fluidized Polymer Suspension and ADMIRAL® 1089FS Fluidized Polymer Suspension comprise low viscosity HEC water-soluble polymers that each produces an aqueous viscosity of less than about 500 cps when added to water in a ratio such that the HEC concentration is 5%.

In addition to the normal amount of the polysaccharide derivative carrier present in the coating, the OBA ingredient should be present in an amount having an upper limit of about 4.0 parts active based on pigment. The preferred upper limit of the OBA is about 2.0 parts, more preferably about 1.0 part. The lower limit of the amount of the OBA is about 0.1 part, preferably 0.2 part, and more preferably about 0.3 part.

In accordance with the present invention, the paper coating is applied by various means to the surface of paper or paperboard to achieve a given coat weight and then dried to form the final paper product. Many conventional methods are known in the prior art for applying the coating to the surface of the paper. Three of the most common types of coaters are blade, rod, and air knife. Blade coaters use a metal or ceramic blade at a certain angle and pressure to meter a several micrometer thick coating onto a sheet. The blade coater is the most common type of coater.

The fluorescing agents or OBAs found to be useful in combination with the nonionic water-soluble cellulose derivatives of this invention include 4,4'-bis(triazinyl) amino-stilbene-2,2'-disulfonic acid (tetra sulfonated) and 4,4'-bis 2-sulfostyryl-biphenyl (distyrylbiphenyl). This first type of OBA (tetra sulfonated) is traditionally used in the paper industry within paper coatings. Distyrylbiphenyl (DSBP) is a new class of OBAs recently offered for paper coatings. Other OBA additives such as disulfonated, and hexasulfonated substituted fluorescing agents would also be expected to be operative with this invention.

In accordance with the present invention, the paper coated with an OBA and the low viscosity, non-ionic, water-soluble polysaccharide derivative of this invention exhibits both whiteness and brightness values of greater than 70, preferably greater than 80 and more preferably greater than 90 units as measured on an X-Rite® 968 Spectrophotometer for whiteness and a Diano ® 5-4 Brightness Tester and Colorimeter for brightness. Also, this paper exhibits an improved supercalender gloss as compared to prior art OBA carriers.

This invention has advantages over the prior art use of polyvinyl alcohol in that the polysaccharide derivative of this invention does not require extensive cooking and preparation as does polyvinyl alcohol (PVA). Thus, this invention represents a significant enhancement in ease of use over prior art. Also, the present invention produces less adverse effect on glossing ability of the coated paper as compared to the PVA prior art OBA carrier.

The following examples are merely set forth for illustrative purposes, but it is to be understood that other modifications of the present invention within the skill of artisans in the industry can be made without departing from the spirit and scope of the invention.

EXAMPLES

Standard Process

Two different coating formulation master batches were prepared. As a first step, the pigment (either all kaolin clay or a 50:50 blend of kaolin/calcium carbonate) was made into an aqueous slurry at 75% total solids. Dispex ® N 40 product (sodium polyacrylate) was used at 0.15 active parts based on pigment as a dispersion aid. After 1 hour of high shear mixing, 10 parts of styrene butadiene latex were added to the pigment slip using low speed agitation. Diluent water as then added to reach approximately 63% solids and pH was adjusted with 30% ammonium hydroxide to 8.5. The final solids reduction to 61.5% was performed in each separate aliquot used for the individual sample coatings.

These formulations differed in the selection of pigment types with one formulation using 100% kaolin clay as the coating pigment, while the other formulation using a mixture of 50% kaolin clay and 50% calcium carbonate (See Table 1 and 2, infra). A standard binder of styrene butadiene latex was used in all tests at 10 parts based on 100 parts of pigment.

Each paper coating type, whether it was based upon 100% kaolin clay pigment or a mixture of kaolin with calcium carbonate, was divided into several aliquots and to each of the aliquots was added various water-soluble polymer additives and OBAs. In the paper-coating tests that used polyvinyl alcohol as the OBA carrier, it was necessary to cook the PVA at 200° F. for at least 40 minutes in order to hydrate completely. In the tests that used HEC as the OBA carrier, it was not necessary to cook the HEC in order to hydrate. This latter polymer was instead added directly to the coating either in solution or in Fluidized Polymer Suspension form and allowed to hydrate with stirring in-situ which required only about 15 minutes. Two different OBAs were used in the study: 4,4'-bis(triazinyl)amino-stilbene-2,2'-disulfonic acid (TETRA), and 4,4'-bis2-sulfostyryl-biphenyl (DSBP).

For runnability purposes, either sodium carboxymethylcellulose or sodium alginate was added to each paper coating to produce a Brookfield viscosity of approximately 1500 cps as measured with an RVT viscometer #4 spindle at 100 RPM. The prepared formulations were then coated onto rolls of commercial 62# paper using a laboratory Dow® coater (Serial #079, Type 89B-SS) at various speeds to give a range of coat weights. The finished-coated paper was recovered and paper samples were selected from each of the tests that corresponded to the equivalent coating weight pick-up of approximately 5 pounds per 3,000 square feet of paper.

These coated paper samples were then measured for whiteness using an X-Rite® 968 Spectrophotometer and for brightness using a Diano® S-4 Brightness Tester and Colorimeter. The standard methods for these instruments were used for each of these measurements.

Example 1

(100% Kaolin Clay Coatings)

In this Example, 100% kaolin clay was used as the paper coating pigment ingredient. The coating formulation tested is shown in Table 1. Descriptions of each water-soluble polymer OBA carrier used in the separate coatings tests are set forth infra in Table 2.

The final paper properties observed for paper that was treated with these various formulations are shown in Tables 4 and 5.

It was found in these tests that ADMIRAL® 1089 FS Fluidized Polymer Suspension, i.e. low viscosity nonionic hydroxyethylcellulose, at 0.5 part active polymer based on pigment with 1.0 part distyrylbiphenyl OBA, produced the highest brightness and second highest whiteness of all OBA carriers tested at this addition level. These results are shown in Table 3. An experimental ultra low viscosity solution of hydroxyethylcellulose gave the highest whiteness results. However, by comparison ADMIRAL® 3089 FS Fluidized Polymer Suspension (the higher viscosity analogue of ADMIRAL® 1089 FS Fluidized Polymer Suspension) produced lower brightness and whiteness results. This result essentially established the unexpected finding of the present invention; low viscosity hydroxyethylcellulose is more effective as an OBA carrier for coated paper than HEC that exhibits an aqueous viscosity of greater than 1500 cps at 5% aqueous concentration.

Distyrylbiphenyl OBA gave an average of 0.6 points of brightness gain or 4.4 points of whiteness versus the 4,4'-bis(triazinyl)amino-stilbene-2,2'-disulfonic acid (TETRA) (See Table 4).

TABLE 1

| 100% Kaolin Clay Recipe | |
|---|---|
| Huber ® Hydrasperse (#2 kaolin clay) | 100 parts |
| Dow ® 620 SBR (styrene butadiene latex) | 10 parts |
| Dispex N-40 (dispersion aid) | 0.1 parts |
| Water addition to 61% solids | |
| OBA Carrier | 0.0, 0.50, or 1 parts |
| OBAs: | |
| 4,4'-bis(2-sulfostyryl) biphenyl) (DSBP) | 0, or 1 parts |
| 4,4'-bis(substituted triazinyl) maino-stilbene-2, 2'-disulfonic acid (TETRA) | |
| CMC 7LCT or 9M31CF (for viscosity control) | Added to thicken coating to Target of 1500 cps |

TABLE 2

| OBA Carriers | |
|---|---|
| Name | Description |
| ADMIRAL ® 1089FS Fluidized Polymer Suspension | 25% active Fluidized Polymers Suspension of Natrosol ® 250LR Hydroxyethylcellulose, 5% active polymer aqueous viscosity <500 cps. |
| ADMIRAL ® 2089FS Fluidized Polymer Suspension | 25% active Fluidized Polymers Suspension of Natrosol ® 250JR Hydroxyethylcellulose, 5% active polymer aqueous viscosity < 500 cps. |
| ADMIRAL ® 3089FS Fluidized Polymer Suspension | 25% active Fluidized Polymers Suspension of Natrosol ® 250GR Hyrdroxyethylcellulose, 5% active polymer aqueous viscosity ≧2000 cps. |
| Experimental Ultra low viscosity HEC | Peroxide-degraded solution of hydroxyethylcellulose, 10% active polymer solution viscosity <100 cps (See U.S Pat. No. 5,480,984) |
| Klucel ® Hydroxypropyl-cellulose Type 99-L | Low molecular weight hydroxypropylcellulose 5% active polymer aqueous viscosity <500 cps |
| Culminal ® MHPC 25 Methylhydroxy-propylcellulose | Low molecular weight methylhydroxypropylcellulose 5% active polymer aqueous viscosity <500 cps |
| Culminal MC25S Methylcellulose | Low molecular weight methylcellulose 5% active polymer aqueous viscosity <500 cps |
| Airvol 203S Polyvinyl Alcohol (Air Products) | 88% hydrolyzed polyvinyl alcohol |

TABLE 3

Various OBA Carriers at 0.5 Parts Dosage with 1 Part DSBP OBA added in 100% Kaolin Clay Coatings

| OBA Carrier @ 0.5 Parts | Coated Paper Brightness | Coated Paper Whiteness |
|---|---|---|
| ADMIRAL ® 1089FS Fluidized Polymer Suspension | 87.0 | 87.7 |
| Airvol ® 203S Polyvinyl Alcohol | 86.3 | 82.6 |
| ADMIRAL ® 3089FS Fluidized Polymer Suspension | 86.4 | 82.1 |
| Experimental Ultra Low viscosity HEC | 85.9 | 88.3 |
| Klucel ® Hydroxypropylcellulose Type 99-L | 86.0 | 87.3 |
| Culminal ® MHPC 25 Methylhydroxypropylcellullose | 85.7 | 87.1 |
| Culminal ® MC25S Methylcellulose | 85.5 | 86.4 |

TABLE 4

Various OBA Carriers, at 0.5 Parts Dosage, with 1 Part of Two OBA Types in 100% Kaolin Clay Coatings

| | Coated Paper Brightness | | Coated Paper Whiteness | |
|---|---|---|---|---|
| OBA Type: | TETRA | DSBP | TETRA | DSBP |
| OBA Carrier | | | | |
| ADMIRAL ® 1089FS Fluidized Polymer Suspension | 85.7 | 87.0 | 81.5 | 87.7 |
| Airvol ® 203S Polyvinyl Alcohol | 85.3 | 86.3 | 81.5 | 82.6 |
| ADMIRAL ® 3089FS Fluidized Polymer Suspension | 85.5 | 86.4 | 81.3 | 82.1 |
| Experimental Ultra Low viscosity HEC | 85.7 | 85.9 | 81.5 | 88.3 |
| Klucel ® Hydroxypropyl-cellulose Type 99-L | 85.7 | 86.0 | 81.9 | 87.3 |
| Culminal ® MHPC 25 Methylhydroxypropylcellulose | 85.2 | 85.7 | 81.1 | 87.1 |
| Culminal ® MC25S Methylcellulose | 85.4 | 85.5 | 81.4 | 86.4 |

Example 2

(50% Kaolin Clay:50% Calcium Carbonate Coatings)

In this series of tests, 50% kaolin clay along with 50% calcium carbonate were used as the coating pigment ingredients. The paper coating formulations tested are shown in Table 5. The descriptions of each water-soluble polymer/OBA carrier are shown above in Table 2. The final paper properties observed for paper that was treated with these various formulations are shown in Tables 6 through 9. All of these coatings were thickened to a target coating viscosity range by adding various quantities of Kelgin® LV sodium alginate.

Since coated paper is normally glossed with a supercalender, brightness and gloss results were taken on supercalendered samples. Supercalender conditions were 2 passes, 100° F., 16.5 feet per minute, and 1,600 pounds per linear inch.

It was found that the coated papers that included DSBP, an OBA, and a low viscosity hydroxyethylcellulose, at 0.5 to 1.0 part based on pigment in the paper coating formulation, exhibited the highest brightness of all OBA carriers evaluated (See Table 6 and 8). By comparison the paper coating that incorporated ADMIRAL® 3089 FS Fluidized Polymer Suspension (the higher viscosity analogue of ADMIRAL® 1089 FS Fluidized Polymer Suspension) or PVA exhibited lower brightness results.

The selection of the OBA type was also found to influence the coated paper brightness. Distyrylbiphenyl OBA gave an average of 1.1 points of brightness gain at the 0.5 part dosage of OBA carrier when compared to 4,4'-bis(triazinyl) amino-stilbene-2,2'-disulfonic acid (TETRA). At the 1.0 part dosage of OBA carrier, distyrylbiphenyl OBA gave 1.5 points of brightness gain compared to 4,4'bis(triazinyl) amino-stilbene-2,2'-disulfonic acid (TETRA) (See Table 7).

Gloss measurements of the various coated paper samples showed that the paper coating that incorporated 0.5 parts of low viscosity hydroxyethylcellulose exhibited the highest gloss values independent of OBA type (See Table 9).

TABLE 5

50% Kaolin Clay: 50% Calcium Carbonate Paper Coating

| | |
|---|---|
| Huber Hydrasperse (#2 kaolin clay) | 50 parts |
| Huber Hydracarb 90 (calcium carbonate) | 50 parts |
| Dow 620 SBR (styrene butadiene latex) | 10 parts |
| Dispex N-40 (dispersion aid) | 0.1 parts |
| Water addition to 61% solids | |
| OBA Carrier | 0.0, 0.25, 0.50, 0.75, or 1 parts |
| OBAs: | 0, or 1 parts |
| 4,4'-bis(2-sulfostyryl) biphenyl) (DSBP) | |
| 4,4'-bis(substituted triazinyl) maino-stilbene-2,2'-disulfonic acid (TETRA) | |
| Kelgin LV Sodium Alginate (for viscosity control) | Added to thicken coating to Target of 1500 cps |

TABLE 6

Hydroxyethylcellulose and Polyvinyl Alcohol at Two Dosages with 50% Kaolin Clay: 50% Calcium Carbonate Paper Coating Recipe, 1 Part DSBP OBA Added

| | Supercalendered Brightness of Coated Paper with 0.5 Parts of OBA Carrier | Supercalendered Brightness of Coated Paper with 1.0 Part of OBA Carrier |
|---|---|---|
| OBA Carrier | | |
| ADMIRAL 1089 FS Fluidized Polymer Suspension | 87.7 | 87.9 |
| Airvol 203S Polyvinyl Alcohol | 86.8 | 87.7 |
| ADMIRAL 3089 FS Fluidized Polymer Suspension | 87.1 | 87.6 |

TABLE 7

Hydroxyethylcellulose and Polyvinyl Alcohol with Two OBA Types, 50% Kaolin Clay: 50% Calcium Carbonate Paper Coating Recipe

| OBA Carrier | Supercalendered Brightness | | Supercalendered Brightness | |
|---|---|---|---|---|
| | 0.5 Parts of OBA Carrier | | 1.0 Part of OBA Carrier | |
| Type of OBA: | TETRA, 1 Part | DSBP, 1 Part | TETRA, 1 Part | DSBP, 1 Part |
| ADMIRAL 1089FS Fluidized Polymer Suspension | 86.3 | 87.7 | 86.2 | 87.9 |
| Airvol 203S Polyvinyl Alcohol | 85.7 | 86.8 | 86.3 | 87.7 |

TABLE 7-continued

Hydroxyethylcellulose and Polyvinyl Alcohol with Two OBA Types, 50% Kaolin Clay: 50% Calcium Carbonate Paper Coating Recipe

| OBA Carrier | Supercalendered Brightness | | Supercalendered Brightness | |
|---|---|---|---|---|
| ADMIRAL 3089 FS Fluidized Polymer Suspension | 86.4 | 87.1 | 86.3 | 87.6 |

TABLE 8

Various Low Viscosity Hydroxyethylcellulose Types, 50% Kaolin Clay: 50% Calcium Carbonate Paper Coating Recipe With 1 Part DSBP OBA

| OBA Carrier | Unsupercalendered Brightness | Supercalendered Brightness |
|---|---|---|
| | 0.5 Parts of OBA Carrier | 0.5 Parts of OBA Carrier |
| Control (No OBA Carrier) | 87.1 | 85.7 |
| ADMIRAL 1089 FS Fluidized Polymer Suspension | 89.6 | 88.6 |
| ADMIRAL 2089 FS Fluidized Polymer Suspension | 89.6 | 88.6 |
| Airvol 203S Polyvinyl Alcohol | 89.6 | 88.1 |

TABLE 9

Gloss Results for Supercalendared Paper Treated with 100% Kaolin Clay Coatings and Various OBA Carriers and OBA Types @ 1 Part

| OBA Carrier | TETRA OBA Coated Paper Gloss Results | DSBP OBA Coated Paper Gloss Results |
|---|---|---|
| 0.50 Parts ADMIRAL 1089 FS Fluidized Polymer Suspension | 56.1 | 58.5 |
| 0.50 Parts Airvol 203S Polyvinyl Alcohol | 55.3 | 55.9 |
| 0.50 Parts ADMIRAL 3089 FS Fluidized Polymer Suspension | 54.6 | 57.2 |

What is claimed:

1. A paper coating composition comprising an optical brightening agent (OBA) and a low viscosity, non-ionic water soluble polysaccharide derivative, exhibiting a solution Brookfield viscosity in water of less than about 1500 cps when dissolved at 5% polymer concentration at ambient temperature, wherein the paper coating provides improved optical brightness as compared to the same formulation without said non-ionic water soluble, polysaccharide derivative.

2. The paper coating composition of claim 1, wherein at least one of a pigment and binder are present.

3. The paper coating composition of claim 2, wherein the amount of the polysaccharide derivative has an upper limit of about 3.0 parts active based on the pigment component.

4. The paper coating composition of claim 2, wherein the amount of the polysaccharide derivate has an upper limit of 2.0 parts active based on the pigment component.

5. The paper coating composition of claim 2, wherein the amount of the polysaccharide derivate has an upper limit of 1.0 parts active based on the pigment component.

6. The paper coating composition of claim 2, wherein the amount of the cellulose derivative has a lower limit of 0.1 parts active based on the pigment component.

7. The paper coating composition of claim 2, wherein the amount of the cellulose derivative has a lower limit of 0.2 parts active based on the pigment component.

8. The paper coating composition of claim 2, wherein the amount of the cellulose derivative has a lower limit of 0.3 parts active based on the pigment component.

9. The paper coating composition of claim 2, wherein the amount of the OBA has an upper limit of 4.0 parts active based of the pigment component.

10. The paper coating composition of claim 2, wherein the amount of the OBA has an upper limit of 2.0 parts active based of the pigment component.

11. The paper coating composition of claim 2, wherein the amount of the OBA has an upper limit of 1.0 parts active based of the pigment component.

12. The paper coating composition of claim 2, wherein the amount of the OBA has a lower limit of about 0.1 parts active based of the pigment component.

13. The paper coating composition of claim 2, wherein the amount of the OBA has a lower limit of 0.2 parts active based of the pigment component.

14. The paper coating composition of claim 2, wherein the amount of the OBA has a lower limit of 0.3 parts active based of the pigment component.

15. The paper coating composition of claim 2, wherein the pigment is selected from the group consisting of kaolin, calcium carbonate (chalk), China clay, amorphous silica, silicates, barium sulfate, satin white, aluminate trihydrate, talcum, titanium dioxide, and mixtures thereof.

16. The paper coating compostion of claim 2, wherein the binder is selected from the group consisting of starch, casein, soy protein, polyvinylacetate, and styrene butadiene latex, acrylate latex and vinylacrylic latex and mixture thereof.

17. The paper coating composition of claim 1, wherein the non-ionic polysaccharide derivate is selected from the group consisting of hydroxyethylcellulose, hydroxypropylcellulose, methylcellulose, methylhydroxyethylcellulose, methylhydroxypropylcellulose, ethylhydroxyethylcellulose, hydroxyethylmethylcellulose, hydropropylmethylcellulose, hydroxyethylguar, hydroxypropylguar, hydroxyethylstarch, and hydroxypropylstarch.

18. The compositions of claim 17 in which the nonionic water-soluble polysaccharide is hydrophobically modified with $C_{4-28}$ alkyl or aryl, or arylalkyl groups.

19. The paper coating composition of claim 1, wherein the upper limit of the 5% aqueous viscosity of the polysaccharide derivative is less than about 1000 cps.

20. The paper coating composition of claim 1, wherein the upper limit of the 5% aqueous viscosity of the polysaccharide derivative is less than 500 cps.

21. The paper coating composition of claim 1, wherein the OBA is the stilbene derivative.

22. The paper coating composition of claim 1, wherein the OBA is selected from the group consisting of 4,4'-bis 2-sulfostyryl-biphenyl.

23. A method of brightening paper comprising coating the paper with the composition of claim 1.

24. The paper of claim 23, wherein the paper exhibits a Brightness value of greater than 70.

25. The paper of claim 23, wherein the paper exhibits a Brightness value of greater than 80.

26. The paper of claim 23 wherein the paper exhibits a Brightness value of greater than 90.

27. The paper of claim 23, wherein the paper exhibits a whiteness value of greater than 70.

28. The paper of claim 23, wherein the paper exhibits a whiteness value of greater than 80.

29. The paper of claim 23, wherein the paper exhibits a whiteness value of greater than 90.

30. The paper of claim 23, wherein the paper exhibits an improved supercalender gloss as compared to prior art carriers.

31. A paper coated with the composition of claim 1.

32. The method of claim 31, wherein the OBA and non-ionic polysaccharide derivative is added to an aqueous mixture of a binder and pigment in the manufacture of paper.

33. A method of making the compostion of claim 1 comprising combining an optical brightening agent and a low viscosity non-ionic polysaccharide derivate.

34. The paper coating composition of claim 1, wherein the low viscosity water-soluble polysaccharide cellulose derivative has an aqueous Brookfield viscosity of less than about 500 cps at 5% concentration in water at 25° C.

* * * * *